United States Patent [19]

Lyman, Jr.

[11] Patent Number: 4,571,895

[45] Date of Patent: Feb. 25, 1986

[54] TELESCOPING SEATING ASSEMBLY

[76] Inventor: Hugh M. Lyman, Jr., 25643 SE. 394th, Enumclaw, Wash. 98022

[21] Appl. No.: 578,028

[22] Filed: Feb. 8, 1984

[51] Int. Cl.[4] ..... E04H 3/16

[52] U.S. Cl. ..... 52/9; 52/183; 108/93; 182/106; 256/59; 297/236

[58] Field of Search ..... 52/9, 183; 108/93, 901; 182/106; 256/59; 297/236, 423, 424, DIG. 2; 49/404

[56] References Cited

U.S. PATENT DOCUMENTS

| | | | |
|---|---|---|---|
| Re. 29,635 | 5/1978 | McClelland et al. | 52/9 |
| 2,797,959 | 7/1957 | Brice | 49/404 X |
| 2,803,841 | 8/1957 | Wellens | 182/106 X |
| 3,127,221 | 3/1964 | Bennett, Jr. | 297/DIG. 2 |
| 3,401,918 | 9/1968 | Wiese | 52/9 |
| 3,904,243 | 9/1975 | Kostelec et al. | 297/DIG. 2 |
| 3,964,215 | 6/1976 | Hartman et al. | 52/9 |
| 4,014,522 | 3/1977 | Sutter | 52/9 |
| 4,030,255 | 6/1977 | Hartman | 52/9 |
| 4,041,655 | 8/1977 | Pari | 52/9 |
| 4,361,991 | 12/1982 | Wiese | 52/9 |
| 4,490,949 | 1/1985 | Sutter et al. | 52/9 |

*Primary Examiner*—Alfred C. Perham
*Attorney, Agent, or Firm*—Seed and Berry

[57] ABSTRACT

A telescoping seating system with a plurality of elongated rows movable between a forward extended use position in which the rows are in stepped relation and a rearward retracted storage position in which the rows are in superposed relation. Each of the rows includes a front riser, a rear riser spaced rearwardly of the front riser, a cantilevered seat fixedly attached to the front riser and extending rearwardly toward the rear riser, and a platform fixedly attached to the front riser and extending between the front riser and the rear riser, forming a self-supporting seat assembly. The seat assembly is mounted to a frame having a pair of laterally spaced, floor-engaging carriages, a pair of columns, each fixedly attached to one of the carriages and extending upwardly therefrom, and a pair of substantially horizontal, forwardly extending, cantilevered support arms each fixedly attached to one of the columns and having the seat assembly mounted thereon by the platform. The columns extend above the support arms and have the rear riser fixedly attached thereto. Positioned along at least one end portion of the rows is a guard structure including a plurality of substantially coplanar, forwardly inclined posts, each fixedly attached to one of the rows for movement therewith. Each of the posts has a plurality of vertically spaced, fixed length rails fixedly attached thereto and extending rearwardly therefrom beyond a next rearward post. The rails are in slidable relation with the rails of the next rearward post and are positioned to vertically interleave in coplanar relation with the rails of successively rearward posts. The posts are laterally upright and forwardly inclined sufficiently to permit nesting of one forward of another. The interleaving of the rails and the nesting of the posts occur in noninterfering relation when the rows are moved from the extended position to the retracted position.

38 Claims, 14 Drawing Figures

TELESCOPING SEATING ASSEMBLY

DESCRIPTION

1. Technical Field

The present invention relates generally to bleacher stands, and more particularly, to telescoping seating systems.

2. Background Art

In the past, telescoping seating systems required that the guard rail structures positioned along the end portions of the rows be removable to permit the movement of the rows between their extended and retracted positions. More recent seating systems, such as those shown in U.S. Pat. Nos. 3,964,215 and 4,030,255 of Hartman, et al. and U.S. Pat. No. 4,014,522 of Sutter, disclose guard rail structures which do not have to be disassembled or removed when the seating system is moved.

All of the aforementioned guard rail structures have their disadvantages, such as requiring the folding, telescoping or dismantling of structural parts; difficulty or expense in manufacturing, assembling or installing; requiring large amounts of space which could otherwise be used for seating; being unable to accommodate the smaller interrail spacings required for safety; being inadequately mounted to the rows or supported thereby; or being incapable or inappropriate for use with seating systems having large numbers of rows.

Other drawbacks of conventional telescoping seating systems are the extensive frame structure required to support the front riser, rear riser, seat and platform components of each seat assembly and the many pieces comprising each component. Another drawback is the great time and effort required to assemble the seat assembly.

It will therefore be appreciated that there has been a significant need for a telescoping seating system which avoids all of the aforementioned disadvantages of conventional systems. The present invention fulfills the need, and further provides other related advantages.

DISCLOSURE OF INVENTION

The present invention resides in a telescoping seating system having a plurality of rows movable between a forward extended use position in which the rows are in stepped relation, and a rearward retracted storage position in which the rows are superposed relation, one above an other in a vertical column. The seating system has a guard structure positioned along at least one end portion of the rows and extendable and retractable therewith. The guard structure has a plurality of forwardly inclined posts, each fixedly attached to one of the rows for movement therewith, and a plurality of vertically spaced, fixed length rails fixedly attached to each of the posts and extending rearwardly therefrom beyond a next rearward post. The plurality of rails are in movable relation with the rails of the next rearward post, and are positioned to vertically interleaf in coplanar relation with the rails of successively rearward posts. The posts are substantially coplanar and forwardly inclined to permit nesting of one forward of an other. The interleaving of the rails and the nesting of the posts occur in noninterfering manner when the rows are moved fom the extended position to the retracted position.

The posts are laterally upright and forwardly inclined by an angle of at least 9 degrees relative to the vertical. The plurality of rails are substantially horizontal and spaced substantially equally distant from each other. The rails attached to each post are interconnected in fixed relation to each other by a spacer fixedly attached to the rails and spaced from the post. In the presently preferred embodiment of the invention, the spacer is fixedly attached to each of the rails of a forward post rearward of a next rearward post, and the spacer is attached to the rails outward of the rows.

The rails of a forward post are verticaly offset from the rails of a next rearward post by substantially one vertical rail space to place pairs of the rails, including one rail from the forward post and one rail from the next rearward post, in substantial juxtaposition, one above the other, with a juxtaposed pair of rails being longitudinally slidable relative to each other. At least one of the plurality of rails of a forward post is slidably retained by a guide fixedly attached to the next rearward post to limit lateral movement of the rail. In the presently preferred embodiment of the invention, the plurality of rails includes no more than six rails. In a second embodiment of the invention, at least one of the plurality of rails has a secondary, horizontally extending rail fixedly attached thereto and positioned to one side thereof between it and an adjacent rail to reduce the unrestricted space therebetween. The spacer interconnecting the plurality of rails is fixedly attached to the secondary rails and is laterally spaced from the plurality of rails.

In a third embodiment of the invention, the rails have a generally vertically extending sidewall with a portion fixedly attached to the post and an other portion spaced a desired lateral distance from the post. The distance is sufficient to permit the other portion to freely move past the fixedly attached portion of a correspondingly positioned rail of a next rearward post. In all disclosed embodiments of the invention, the rails are attached to the post outward of the rows, and each of the posts is fixedly attached to one of the rows by a pair of spaced-apart, parallel, rigid mounting plates. One of the plates is mounted to a seat portion of the row and the other plate is mounted to a floor portion of the row.

In accordance with another aspect of the invention, the telescoping seating assembly has an elongated, self-supporting seat assembly for attachment to a support frame. The seat assembly includes a front riser, a cantilevered seat fixedly attached to the front riser and extending rearwardly therefrom, and a platform fixedly attached to the front riser and extending rearwardly therefrom. The platform supports the front riser and seat, and the front riser, seat and platform are fabricated as a unitary structure attachable to the support frame. The seat assembly further includes a rear riser positioned substantially parallel to and spaced rearwardly of the front riser, and fixedly attached to the platform.

The front riser, rear riser, seat and platform are separate components integrally joined during fabrication to form a preassembled structure. The seat assembly further includes a first gusset fixedly attached to the front riser and the seat along their juncture, and a second gusset fixedly attached to the front riser and the platform along their juncture to provide additional structural strength. The seat assembly is reinforced with fiberglass and bonded with polyester resin using injection molding, such as a resin transfer method. A contour is provided for the seat.

The frame supporting each seat assembly includes a pair of laterally spaced, floor-engaging movable support means; a pair of columns, each fixedly attached to one of the support means and extending upwardly therefrom; and a pair of substantially horizontal, forwardly extending, cantilevered support arms, each fixedly attached to one of the columns and having the seat assembly mounted thereon by the platform. The columns extend upwardly beyond the support arms for attachment of the rear riser thereto. The frame further includes at least one pair of laterally inclined braces, each fixedly attached to and extending between one of the columns and the rear riser for improving lateral rigidity of the seating system.

Other features and advantages of the invention will become apparent from the following detailed description, taken in conjunction with the accompanying drawings.

BEST MODE FOR CARRYING OUT THE INVENTION

Figure 1:
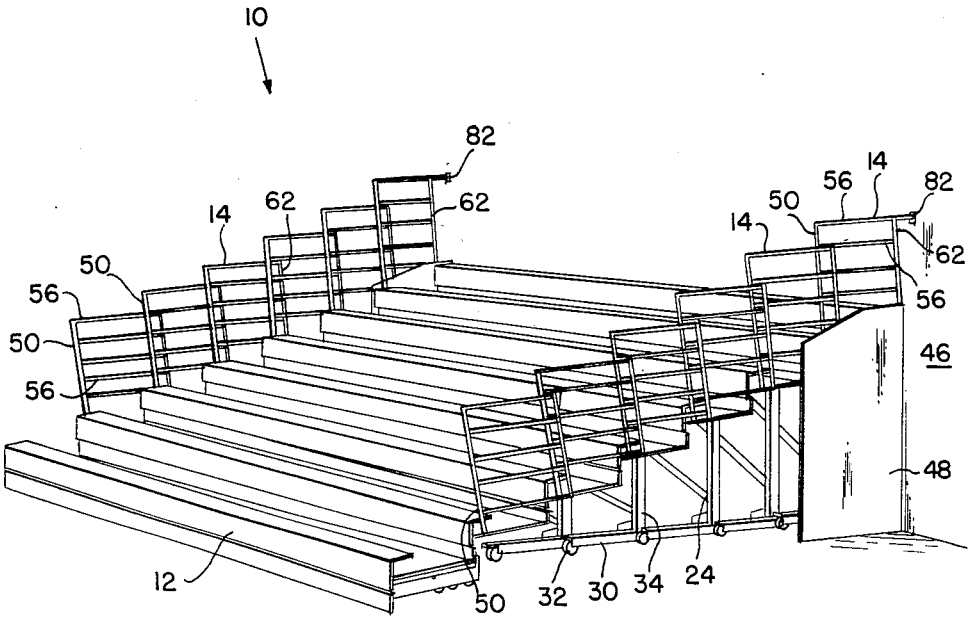
FIG. 1 is an isometric view of a telescoping seating system embodying the present invention, showing the seating system in a forward extended use position and a five rail guard rail structure.
Figure 1A:
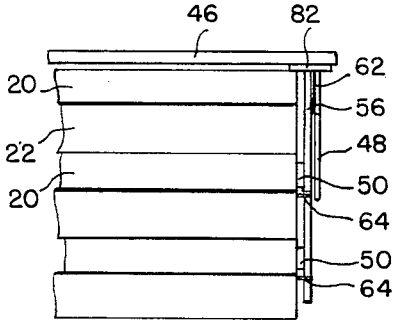
FIG. 1A is a fragmentary top plan view of the right side guard rail structure of the seating system of FIG. 1.
Figure 2:
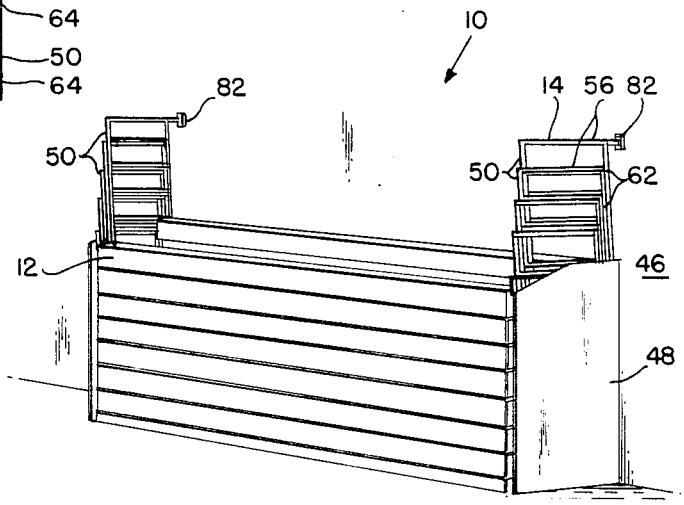
FIG. 2 is an isometric view of the seating system of FIG. 1, showing the seating system in a rearward retracted storage position.
Figure 4:
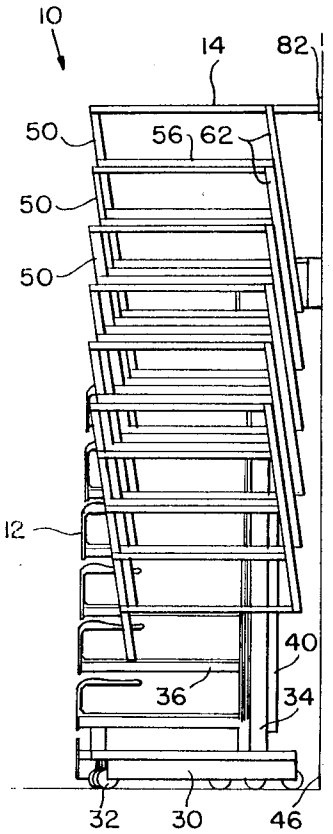
FIG. 4 is a side elevational view of the seating system of FIG. 3, showing the seating system in the rearward retracted storage position with the guard rail structure in nested arrangement.
Figure 3:
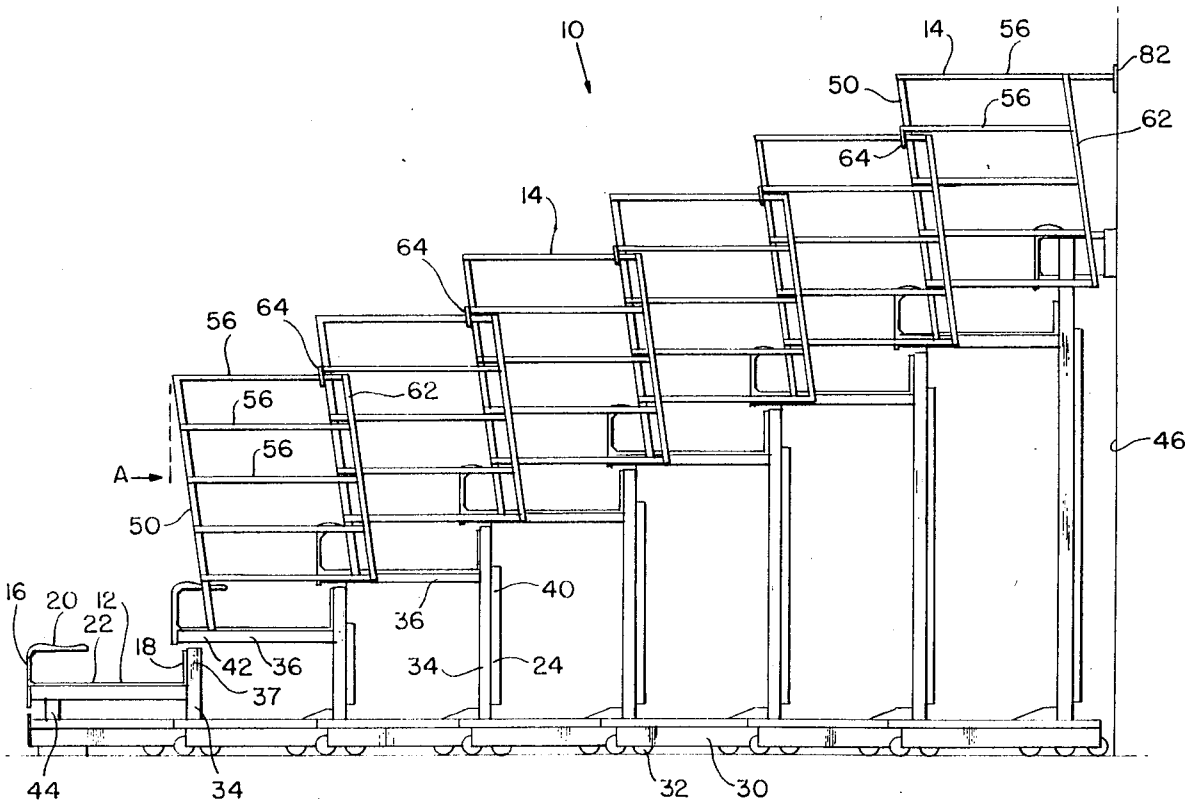
FIG. 3 is an enlarged, side elevational, sectional view of the seating system of FIG. 1 shown in the forward extended use position.

As shown in the drawings for purposes of illustration, the present invention is embodied in a telescoping seating system, indicated generally by reference numeral 10. The seating system 10 includes a plurality of rows of elongated seat assemblies 12 movable between a forward extended use position in which the rows are in stepped relation, as shown in FIGS. 1 and 3, and a rearward and a retracted storage position in which the rows are in superposed relation one above the other in a vertical column, as shown in FIGS. 2 and 4. Provided at both end portions of the rows of seat assemblies 12 is a guard structure 14.

Figure 5:
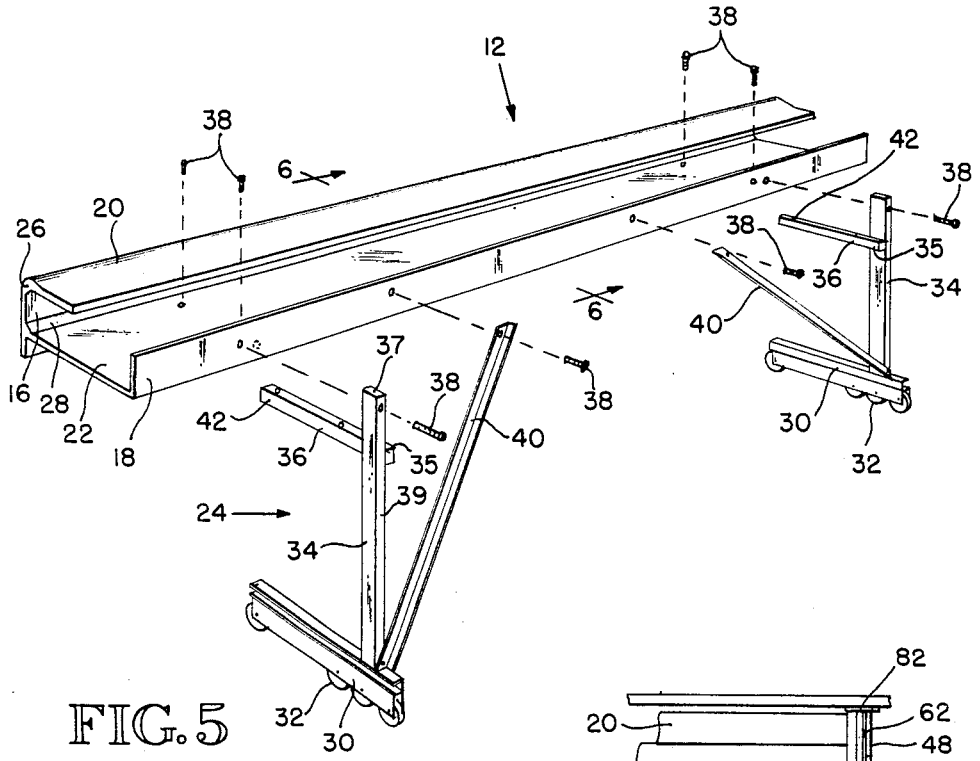
FIG. 5 is an enlarged, exploded, rear perspective view of a seat assembly of the seating system of FIG. 1.
Figure 6:
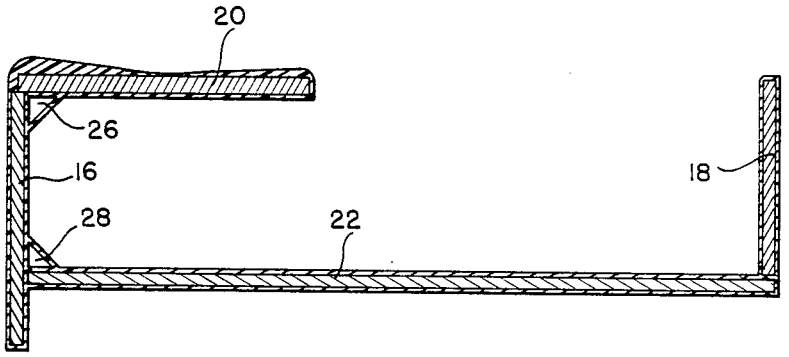
FIG. 6 is an enlarged sectional view taken substantially along the line 6—6 of FIG. 5.
Figure 7:
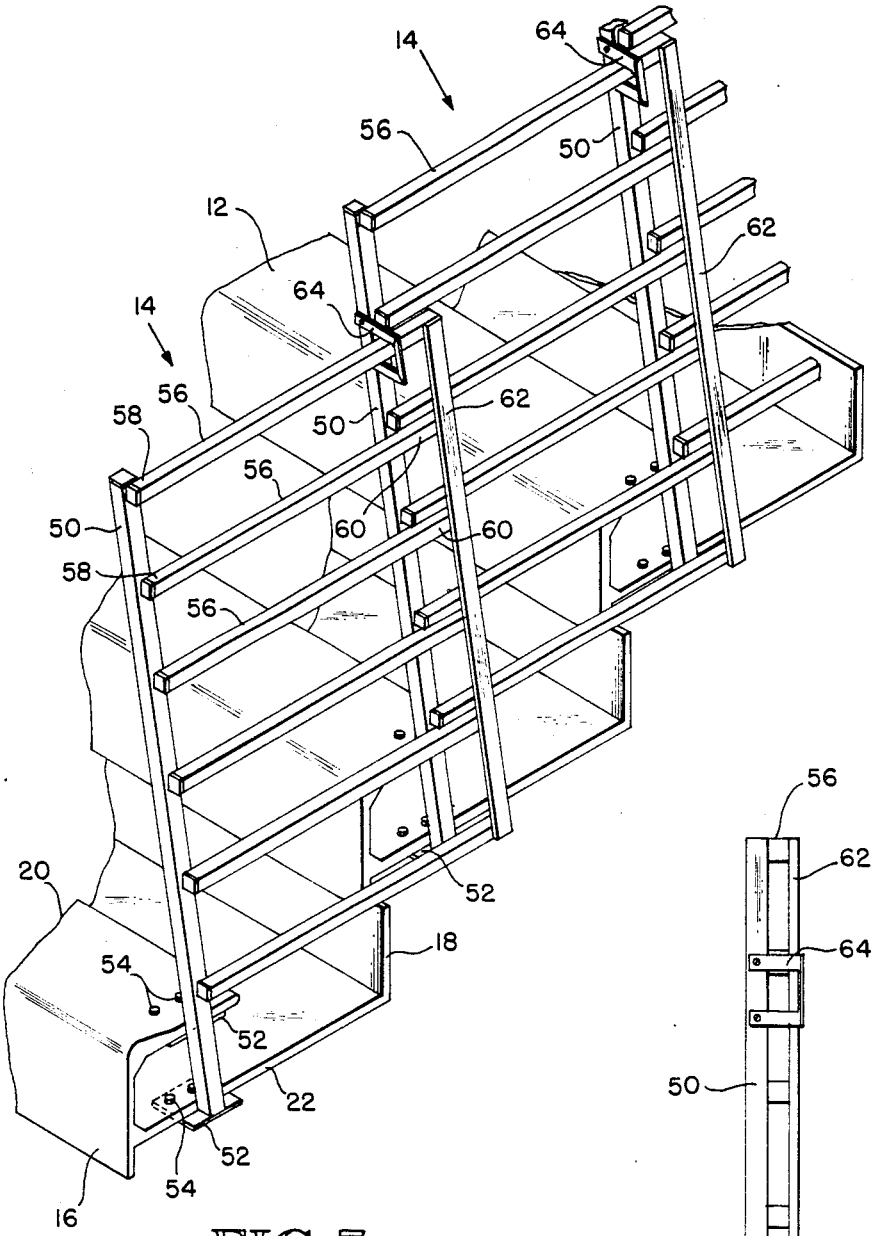
FIG. 7 is an enlarged, fragmentary, isometric view of an embodiment of the seating system of FIG. 1 (with a six rail guard rail structure), showing the right side guard rail structure.
Figure 8:
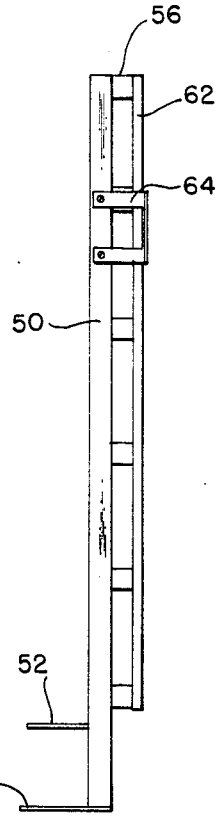
FIG. 8 is a front elevational view of the guard rail structure of FIG. 7 shown disassembled from the seat assembly.

As best illustrated in FIGS. 5 and 6, each of the seat assemblies 12 includes an elongated front riser 16, an elongated rear riser 18 positioned substantially parallel to and spaced rearwardly of the front riser; an elongated, cantilevered seat 20 fixedly attached to the upper end of the front riser and extending rearwardly toward the rear riser; and an elongated, horizontal platform 22 extending between the front riser and the rear riser, and fixedly attached to both. The front riser 16, the rear riser 18, the seat 20 and the platform 22 are fabricated as a unitary, preassembled structure easily attachable to a frame 24 during assembly of the seating system 10, as will be described in more detail below.

In the present preferred embodiment of the invention, the front riser 16, rear riser 18, seat 20 and platform 22 of the seat assembly 12 are separate components integrally joined during fabrication. Each component may be comprised of several pieces, such as when the seat assembly is to be longer than the standard length for the material from which the pieces are formed or cut. This being the situation frequently encountered in the manufacture of conventional seating systems utilizing plywood, which comes in standard eight-foot lengths and requires a frame structure to support each joint between adjacent pieces. The present invention eliminates the need for frame support of joints.

The fabrication process utilizes fiberglass reinforcement and bonding with polyester resin applied through injection molding. The particular injection molding process presently used is a conventional resin transfer method (RTM) in which the preassembled pieces of the seat assembly components are wrapped in fiberglass cloth and placed in a mold into which resin is injected to impregnate the cloth. The mold is shaped to provide a contoured seat surface for the seat 20. As will be described in more detail below, when the seating system 10 is in use, the platform 22 supplies the complete support for the front riser 16 and seat 20 without any direct structural support from the frame 24. As such, a simplified and less expensive frame is possible.

To provide additional strength at the juncture of the seat 20 and the front riser 16, a first gusset 26 is provided. The first gusset 26 is triangular in cross-section, extends the length of the seat assembly 12, and is fixedly attached to both the front riser 16 and the seat 20. To provide additional strength at the juncture of the platform 22 and the front riser 16, a second gusset 28 is provided. The second gusset 28 is also triangular in cross-section and extends the length of the seat assembly 12, and is fixedly attached to both the front riser 16 and the platform 22. It is noted that while in the preferred embodiment of the invention the front riser 16, the rear riser 18, the seat 20 and the platform 22 are separate components integrally joined during fabrication, the seat assembly 12 may be manufactured as a unitary member, such as by using extruded aluminum or molded plastic.

The seat assembly 12 of the present invention, requires use of no bolts for its assembly, and as will be described in more detail below, only eight bolts to attach the seat assembly to the frame 24. Only four of these bolts are used to hold the seat assembly 12 down and the other four are used to attach rear support members to the seat assembly. This is to be compared with conventional seat assemblies which require up to approximately fifty bolts just to assemble the seating assembly, plus the bolts necessary to attach the seating assembly to the frame and to attach rear support members. This produces a corresponding savings in time and expense of assembly. The seat assembly 12 of the present invention also provides the advantage of an obstruction-free platform 22, with the front and rear risers 16 and 18 providing a walled enclosure which may be easily swept to remove debris and which prevents debris from falling under the seating system 10 to the floor below where it is difficult to reach for cleaning.

Using the fabrication techniques described, the cantilevered seat 20 and the platform 22 have been proven able to support loads of at least 100 pounds per square foot. As will be described in more detail below, the seat assembly 12 of the present invention also serves as a beam structure which coacts with the frame 24 to provide structural strength to the seating system 10 and reduce the complexity and amount of frame structure required, as compared to conventional telescoping seating systems, to achieve the necessary strength, rigidity and stability.

The frame 24 includes for each seat assembly 12, a pair of laterally spaced, floor-engaging carriages 30. Each of the carriages 30 is supported by a plurality of wheels 32 which permit the easy rolling of the carriage 30 for moving the seating system 10 between its forward extended and rearward retracted positions. The carriage 30 for each seat assembly 12 is positioned laterally inward of the carriage for the next rearward and elevated seat assembly to place the carriages in parallel, side-by-side relation when the seating system is moved to its rearward retracted position. The carriage 30 of the rearwardmost and highest elevation seat assembly is positioned to place it substantially adjacent to the end portion of the seat assembly 12 and slightly inward therefrom.

The frame 24 further includes a pair of vertical columns 34 each fixedly attached to one of the pair of carriages 30 for the seat assembly 12 and extending upwardly therefrom. A pair of substantially horizontal, forwardly extending, cantilevered support arms 36 are each fixedly attached by an end portion 35 to an inward side 39 of each of the columns 34 at a selected distance below an upper end 37 of the column. The platform 22 of the seat assembly 12 is mounted on the support arms 36 forward of the columns 34 and attached to each support arm by two fasteners 38. The rear riser 18 of the seat assembly 12 is attached to the portion of each of the columns 34 extending above the support arm 36 by another fastener 38. A pair of laterally extending diagonal braces 40 are each fixedly attached to and extend between a lower portion of one of the columns 34 and a midportion of the rear riser 18 to brace the seating system 10 against lateral sway.

Each successive seat assembly 12 from the front to the rear of the seating system 10 is carried by a similar frame 24 with a progressively taller column 34 to place the seat assemblies in stepped relation with each other when the seating system is in the forward extended use position, and to permit placement of the seat assemblies in superimposed relation one above another in a vertical column when the seating system is moved into its rearward retracted storage position. The laterally inward spacing of the carriages 30 of successive seat assemblies 12 from the rear to the front and the height of the columns 34 are designed such that when the seating system 10 is in its forward extended use position, a forward free end 42 of the cantilevered support arm 36 is aligned and positioned immediately above the upper end 37 of the next forward vertical column 34 to provide support for the free end of the arm when a load is applied to the seat assembly by people sitting or standing on the seat 20 assembly 12. The free end 37 of the support arm 36 of the forwardmost seating assembly 12 carries below it a vertical member 44 which extends downward from the arm to a distance slightly above the floor to support the free end when a load is applied. It is noted that the lateral spacing of the carriages 30 must be sufficient that two adjacent columns 34 clear each other when the seating system 10 is moved between its forward extended and rearward retracted positions. Additional diagonal braces (not shown) may be provided extending between a midportion of the column 34 and the rear riser 18, particularly for the more elevated seat assemblies 12, if the seating system 10 has a sufficient number of rows of seating assemblies that the height requires additional braces against lateral sway.

Positioned to each side of the frame 24 and held stationary against a wall 46 to which the seating system 10 is anchored is a decorative side panel 48. The side panel 48 is sized to conceal the frame 24 when the seating system 10 is in its rearward retracted storage position.

The guard structure 14 of the present invention includes a plurality of forwardly inclined, laterally upright posts 50 each fixedly attached to an end portion of the seat assembly 12 for travel therewith by a pair of spaced-apart, parallel, horizontally oriented plates 52. The plates 52 are fixedly attached to the underside of the seat 20 and the platform 22 by fasteners 54. As best shown in FIG. 4, all the posts 50 are attached to the seat assemblies 12 at the same relative position to place the base of each post directly above the bases attached to the more forward seat assemblies, when viewed with the seating system 10 in the rearward retracted position.

The guard structure 14 further includes a plurality of vertically spaced, substantially horizontal rails 56 attached to each of the posts 50 and extending rearwardly therefrom a sufficient distance to extend beyond the next rearward post when the seating system 10 is in its forward extended use position. The rails 56 attached to each post 50 have a fixed length and are spaced substantially equidistant from each other. Each rail 56 is fixedly attached to a side of the post 50 outward of the seat assemblies 12 by a forward end portion 58 and has a rearward end portion 60 which is interconnected in fixed relation to the rearward end portion of each other rail attached to the same post by a spacer bar 62. The spacer bar 62 is attached to the outward side of the rails 56 to avoid interference with operation of the seating assembly 10 as a result of contacting the posts 50 or the plates 52 by which the posts are attached to the seat assemblies 12. The rails 56 of a forward post 50 are longitudinally slidable relative to the rails of the next rearward post, and are vertically offset therefrom by substantially one vertical rail spacing plus the height of one rail to place the top rail of the forward post immediately below the second uppermost rail of the rearward post and in substantial juxtaposition therewith.

In some of the presently preferred embodiments of the invention (see FIGS. 7–12), each post 50 is provided with six rails 56, with the top rail being vertically positioned just below the second uppermost rail of the next rearward post, the second uppermost rail of the first post being positioned below the third uppermost rail of the next rearward post, the third uppermost rail of the forward post being positioned below the fourth uppermost rail of the next rearward post, the fourth uppermost rail of the forward post being positioned below the fifth uppermost rail of the next rearward post, and the fifth uppermost rail of the forward post being positioned below the sixth and lowest rail of the next rearward post. With such an arrangement, the rails 56 of all posts 50 are in coplanar relation, and the rails of each successive post from the front to the rear of the seating system are positioned at a higher elevation than the rails of the immediately forward post to provide a stepped configuration corresponding to the stepping of the seat assemblies 12.

Figure 4A:
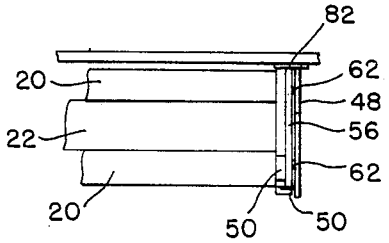
FIG. 4A is a fragmentary front elevational view of the guard rail structure of FIG. 4.

The vertical interrail spacing, i.e., the vertical distance between adjacent rails 56, is sufficient to permit interleaving of the rails of several forward posts 50 between adjacent rail pairs of rearward posts in parallel, noninterfering relation as the seating system 10 is moved from the forward extended position to the rearward retracted position. In the embodiment of the invention using six equally spaced rails, the interrail spacing must be sufficient to permit the interleaving of four rails therebetween. If five rails are used, as shown in FIGS. 1–4, the inter-rail spacing must accommodate only three rails therebetween. As shown most clearly in FIGS. 4 and 4A for the five rail embodiment, while the seating system 10 may include an unlimited number of seat assemblies 12, each having a guard structure 14 attached thereto, the most a pair of adjacent rails for any one post must accommodate between them is three rails of other, more forward posts.

The posts 50 are forwardly inclined by a sufficient angle "A" from the vertical to permit nesting of each post in a position forward of and against the next rearward post in parallel, noninterfering relation when the seating system 10 is moved to the rearward retracted position. In the presently preferred embodiment of the invention, the posts 50 are forwardly inclined by an angle of 9 degrees. The post 50, just rearward of the forwardmost post, and each one rearward therefrom, may be provided with a U-shaped guide 64 fixedly attached by its free ends to the post and slidably retaining the top rail 56 of the next forward post to limit lateral movement of the rail.

Figure 9:
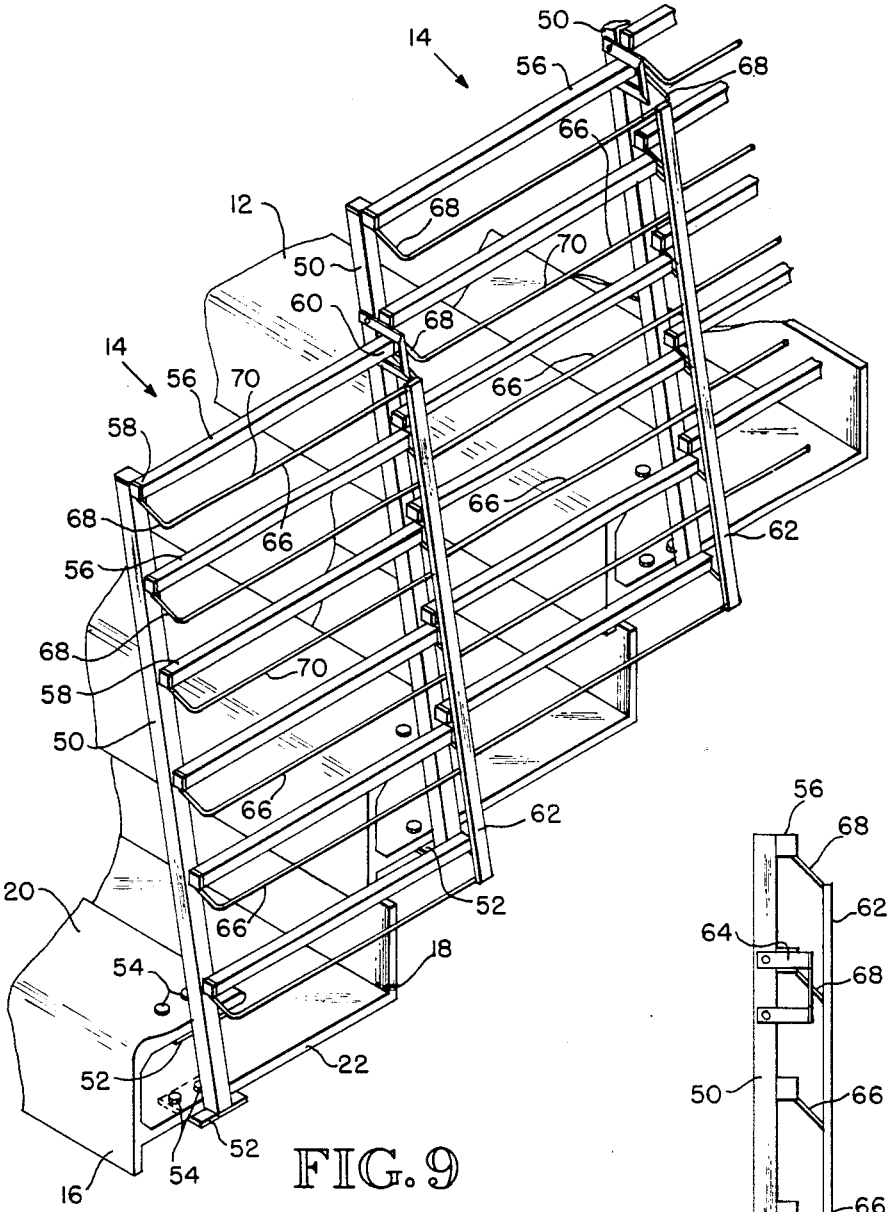
FIG. 9 is an enlarged, fragmentary, isometric view of an embodiment of the seating system of FIG. 1 with an alternative guard rail structure.
Figure 10:
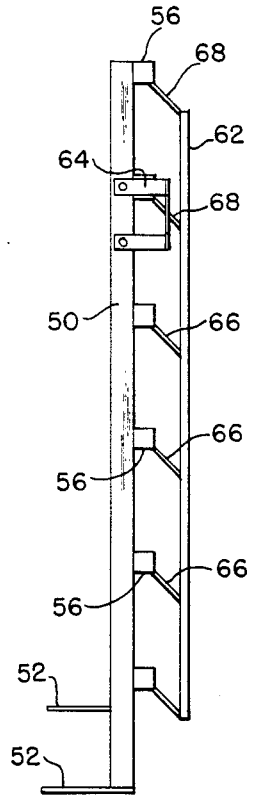
FIG. 10 is a front elevational view of the guard rail structure of FIG. 9 shown disassembled from the seat assembly.

In one alternative embodiment of the invention, shown in FIGS. 9 and 10, each of the rails 56 is provided with a secondary rail or drop bar 66 fixedly attached thereto and extending outward of and below the rail to which it is attached. The secondary rail 66 is generally U-shaped, having a pair of short arms 68 attached to the ends of the rail 56 and a horizontally extending rail portion 70 which is positioned partially between the rail to which the secondary rail 66 is attached and the next lower rail to effectively reduce the unrestricted vertical space between the rails 56. In this embodiment of the invention, the spacer bar 62 is fixedly attached to the rail portions 70 of the secondary rail 66, placing the spacer bar outward of the seating assemblies 12 and at a distance from the rails 56. Safety requirements such as those set forth in the Uniform Building Code, 1982 edition, require an interrail spacing sufficiently small that a 6-inch sphere cannot pass therethrough and are satisfactorily met with the use of the secondary rail 66 without requiring additional main rails 56, which must have sufficient space therebetween for interleaving of other rails. The exact number and space required depend on the number of rails attached to each post 50.

Figure 11:
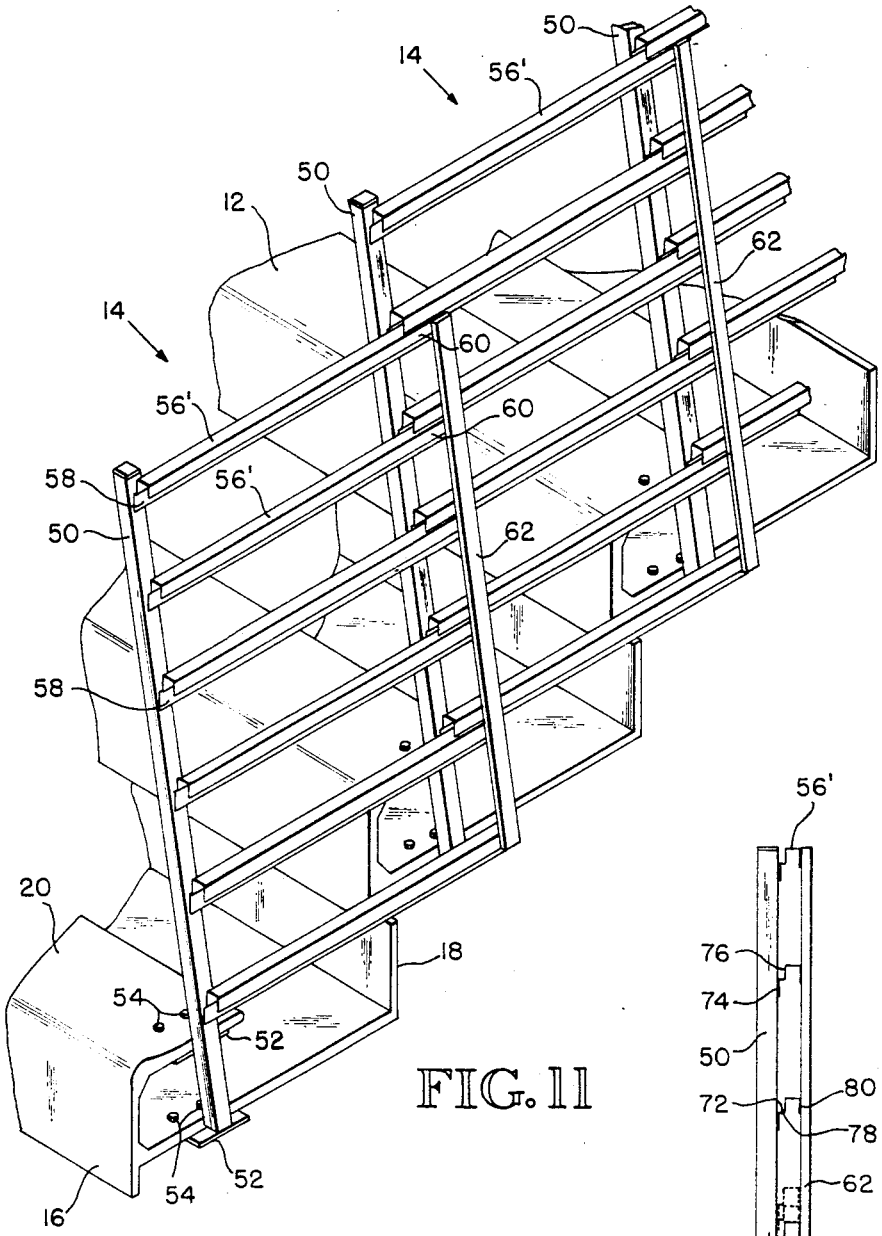
FIG. 11 is an enlarged, fragmentary, isometric view of another embodiment of the seating system of FIG. 1 with another alternative guard rail structure.
Figure 12:
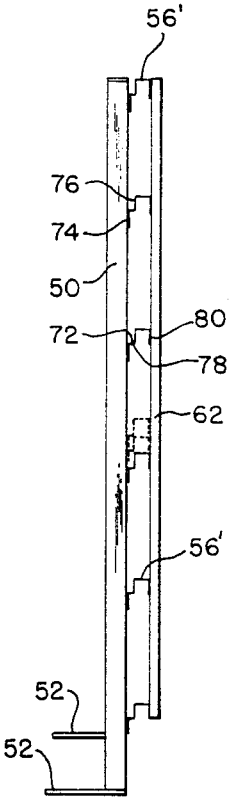
FIG. 12 is a front elevational view of the guard rail structure of FIG. 11 shown disassembled from the seat assembly.

In another alternative embodiment of the invention, shown in FIGS. 11 and 12, the rails 56' have a generally inverted U-shaped cross-section, and are sized and positioned to nest one adjacent to the other. With reference to the cross-section of the rail 56', the rail has a vertical inward side 72, with a lower portion 74 fixedly attached to the outward side of the post 50 and an upper portion 76 spaced laterally from the rail with a connecting portion 78 therebetween. The lower portion 74 of the rail 56' of the next rearward post 50 is vertically positioned to correspond to the position of the upper portion 76 of the rail of the forward post. The upper portion 76 is spaced from the post 50 sufficiently to allow the upper portion of the rail 56' to move freely past the lower portion 74 of the rail 56' of the next rearward post 50 and to permit the relatively tight vertical nesting of the rails one above the other as the seating system is moved from its forward extended position to its rearward retracted position. The rail 56' also has a vertical outward side 80 to which the spacer bar 62 is attached. The vertical inward side 72 of the rail 56' may be made to extend over any desired vertical distance to effectively decrease the interrail spacing and reduce the unrestricted vertical space between rails, but still permit the interleafing of rails necessary to allow the seating assembly 10 to operate without removal or disassembly of the rails. It is noted that the unrestricted vertical space between the rails 56' can be easily reduced with this rail shape without increasing the number of rails used by merely increasing the vertical size of the lower portion 74 of the rail.

In all embodiments of the invention, the guard structure 14 may be secured to the wall 46 for lateral stability. The post 50 attached to the secondmost rearward seat assembly 12 has an extended top rail 56 which extends rearwardly beyond the spacer bar 62 and is fixedly attached to the wall by a mounting plate 82. In other situations, the guard structure 14 may be secured to a rear panel or a back railing which travel with the seating system 10. As is conventional, the seating system 10 may be a fully movable unit, or have its forward or rearward row attached to the floor.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A telescoping seating system comprising:

a plurality of rows movable between a forward extended use position in which said rows are in stepped relation and a rearward retracted storage position in which said rows are in superposed relation, one above another in a vertical column; and a guard structure positioned along at least one end portion of said rows being extendable and retractable therewith, said guard structure including a plurality of forwardly inclined, laterally upright posts each fixedly attached to one of said rows, a plurality of vertically spaced, substantially horizontal rails fixedly attached to each of said posts and extending rearwardly therefrom, said rails being spaced substantially equidistant from each other, said rails of at least one forward post extending rearwardly beyond a next rearward post when said rows are in said extended position, and each having a forward end portion fixedly attached to said forward post and a rearward end portion interconnected in fixed relation to each other by a spacer, said rails of said forward post being vertically offset from said rails of said next rearward post by substantially one or more vertical rail spaces to place pairs of said rails, including one rail from said forward post and one rail from said rearward post, in substantial juxtaposition, one above the other, said juxtaposed pairs of rails being longitudinally movable relative to each other, said posts being forwardly inclined sufficiently to permit nesting of one post forward of and against another post and said vertical space between said rails being sufficient to permit interleaving of said plurality of rails of said forward post between said plurality of rails of said next rearward post in parallel, noninterfering relation when said rows are moved from said extended position to said retracted position.

2. The seating system of claim 1 wherein said plurality of rails are attached to each of said posts outward of said rows.

3. The seating system of claim 2 wherein said spacer is fixedly attached to said plurality of rails outward of said rows.

4. The seating system of claim 1 wherein said next rearward post has a guide fixedly attached thereto and slidably retaining one of said plurality of rails of said forward post to limit lateral movement thereof.

5. The seating system of claim 1 wherein said spacer is fixedly attached to each of said plurality of rails of said forward post rearward of said next rearward post.

6. The seating system of claim 1 wherein said posts are forwardly inclined by an angle of at least 9 degrees relative to the vertical.

7. The seating system of claim 1 wherein said plurality of rails includes no more than six rails.

8. The seating system of claim 1 wherein one or more of said plurality of rails has a secondary, horizontally extending rail fixedly attached thereto and positioned to one side therebelow to reduce the unrestricted vertical space between said rails.

9. The seating system of claim 8 wherein said spacer interconnecting said plurality of rails is fixedly attached to said secondary rails and laterally spaced from said plurality of rails.

10. The seating system of claim 1 wherein each of said posts is fixedly attached to each of said rows by a pair of spaced-apart, parallel, rigid mounting plates, one mounted to a seat portion and one to a floor portion of said row.

11. A telescoping seating system comprising a plurality of rows movable between a forward extended use position in which said rows are in stepped relation and a rearward retracted storage position in which said rows are in superposed relation one above another in a vertical column, and a guard structure positioned along at least one end portion of said rows and including a plurality of substantially coplanar, forwardly inclined posts each fixedly attached to one of said rows for movement therewith, a plurality of vertically spaced, fixed length rails fixedly attached to each of said posts and extending rearwardly therefrom beyond a next rearward post and in movable relation with said rails thereof, said plurality of rails being positioned to interleave in coplanar relation with said rails of successively rearward posts, and said posts being forwardly inclined to permit nesting of one forward of another in noninterfering relation when said rows are moved from said extended position to said retracted position.

12. The seating system of claim 11 wherein said posts are laterally upright.

13. The seating system of claim 11 wherein said plurality of rails are substantially horizontal and spaced substantially equidistant from each other.

14. The seating system of claim 11 wherein said plurality of rails are interconnected in fixed relation to each other by a spacer fixedly attached to said rails and spaced from said post.

15. The seating system of claim 14 wherein said spacer is fixedly attached to each of said plurality of rails of a forward post rearward of a next rearward post.

16. The seating system of claim 14 wherein said spacer is fixedly attached to said plurality of rails outward of said rows.

17. The seating system of claim 11 wherein said rails of a forward post are vertically offset from said rails of a next rearward post by substantially one vertical rail space to place pairs of said rails, including one rail from said forward post and one rail from said next rearward post, in substantial juxtaposition, one above the other, said juxtaposed pairs of rails being longitudinally movable relative to each other.

18. The seating system of claim 11 wherein at least one of said plurality of rails of a forward post is slidably retained by a guide fixedly attached to a next rearward post to limit lateral movement of said at-least-one-rail.

19. The seating system of claim 11 wherein said posts are forwardly inclined by an angle of at least 9 degrees relative to the vertical.

20. The seating system of claim 11 wherein said plurality of rails includes no more than six rails.

21. The seating system of claim 11 wherein at least one of said plurality of rails has a secondary, horizontally extending rail fixedly attached thereto and positioned to one side thereof between said at-least-one-rail and an adjacent rail to reduce the unrestricted vertical space therebetween.

22. The seating system of claim 21 wherein a spacer interconnects said plurality of rails and is fixedly attached to said secondary rails, laterally spaced from said plurality of rails.

23. The seating system of claim 11 wherein each of said posts is fixedly attached to each of said rows by a pair of spaced, substantially parallel, rigid mounting plates, one mounted to a seat portion and one to a floor portion of said row.

24. The seating system of claim 11 wherein said plurality of rails are attached to said posts outward of said rows.

25. The seating system of claim 11 wherein said rails have a generally vertically extending sidewall with a portion fixedly attached to said post and an other portion spaced a desired lateral distance from said post, said distance being sufficient to permit said other portion to freely move past said fixedly attached portion of a correspondingly positioned rail of a next rearward post as said rows are moved between said extended and retracted positions.

26. A guard rail structure for a telescoping seating system having a plurality of rows between a forward extended use position in which said rows are in stepped relation and a rearward retracted storage position in which said rows are in superposed relation to one above another in a vertical column, and positionable along at least one end portion of said rows for extension and retraction therewith, comprising a plurality of substantially coplanar, forwardly inclined posts each fixedly attachable to one of said rows for movement therewith, a plurality of vertically spaced, fixed length rails fixedly attached to each of said posts and extending rearwardly therefrom beyond a next rearward post and in slidable relation thereto, said plurality of rails being positioned to interleave in coplanar, substantially parallel, spaced relation with rails of successively rearward posts, and said posts being forwardly inclined to permit nesting of one forward of another in non-interfering relation when said rows are moved from said extended position to said retracted position.

27. An elongated, self-supporting seat assembly for attachment to a bleacher stand support frame, comprising:

a front riser;

a cantilevered seat fixedly attached to said front riser and extending rearwardly therefrom; and a platform fixedly attached to said front riser and extending rearwardly therefrom, said platform supporting said front riser and seat, and said front riser, seat and platform being fabricated as a unitary structure attachable to the bleacher stand support frame.

28. The seat assembly of claim 27, further including a first gusset fixedly attached to said front riser and said seat along their juncture.

29. The seat assembly of claim 28, further including a second gusset fixedly attached to said front riser and said platform along their juncture.

30. The seat assembly of claim 27 wherein said front riser, seat and platform are separate components integrally joined during fabrication to form a preassembled structure.

31. The seat assembly of claim 27, further including a rear riser positioned substantially parallel to and spaced rearwardly of said front riser, and fixedly attached to said platform.

32. The seat assembly of claim 31 wherein said front riser, rear riser, seat and platform are separate components integrally joined during fabricaion to form a preassembled structure.

33. The seat assembly of claim 32 wherein said front riser, rear riser, seat and platform are reinforced with fiberglass and bonded with polyester resin.

34. The seat assembly of claim 33 wherein said bonding is accomplished by injection molding.

35. The seat assembly of claim 34 wherein said seat is contoured.

36. A telescoping seating system comprising a plurality of elongated rows movable between a forward extended use position in which said rows are in stepped relation and a rearward retracted storage position in which said rows are in superposed relation, each of said rows including a front riser, a rear riser spaced rearwardly of said front riser, a cantilvered seat fixedly attached to said front riser and extending rearwardly toward said rear riser, and a platform fixedly attached to said front riser, said seat, front riser and platform forming a self-supporting seat assembly, said seat assembly being mounted to a frame including a pair of laterally spaced, floor-engaging, movable support means, a pair of columns each fixedly attached to one of said support means and extending upwardly therefrom, and a pair of substantially horizontal, forwardly extending, cantilevered support arms each fixedly attached to one of said columns and having said seat assembly mounted thereon by said platform, the seating system further including a guard structure positioned along at least one end portion of said rows and being extendable and retractable therewith, said guard structure including a plurality of substantially coplanar, forwardly inclined posts each fixedly attached to one of said rows for movement therewith, a plurality of vertically spaced, fixed length rails fixedly attached to each of said posts and extending rearwardly therefrom beyond a next rearward post and in movable relation wih said rails thereof, said plurality of rails being positioned to vertically interleave in coplanar relation with said rails of successively rearward posts, and said posts being forwardly inclined sufficiently to permit nesting of one forward of another in noninterfering relation when said rows are moved from said extended position to said retracted position.

37. The seating system of claim 36 wherein said rear riser is fixedly attached to said platform to form a part of said self-supporting seat assembly, and said columns extend upwardly beyond said support arms for attachment of said rear riser thereto.

38. The seating system of claim 37 wherein said frame further includes at least one pair of laterally inclined braces each fixedly attached to and extending between one of said columns and said rear riser for improving lateral rigidity of the seating system.

* * * * *